United States Patent [19]

Gartzke

[11] 4,292,816

[45] Oct. 6, 1981

[54] ICE MAKING APPARATUS

[76] Inventor: Rudolph E. Gartzke, 2326 Superior St., Madison, Wis. 53704

[21] Appl. No.: 106,706

[22] Filed: Dec. 26, 1979

Related U.S. Application Data

[63] Continuation-in-part of Ser. No. 936,233, Aug. 24, 1978, and Ser. No. 793,936, May 5, 1977, abandoned.

[51] Int. Cl.[3] ..... F25C 1/10

[52] U.S. Cl. ..... 62/345; 62/347; 62/351

[58] Field of Search ..... 62/340, 74, 73, 351, 62/345, 347, 352

[56] References Cited

U.S. PATENT DOCUMENTS

| | | | |
|---|---|---|---|
| 2,025,711 | 12/1935 | Bemis | 62/345 X |
| 2,054,074 | 9/1936 | Field | 62/351 X |
| 2,246,941 | 6/1941 | Hoyer | 62/73 |
| 3,253,425 | 5/1966 | McKissick | 62/345 |
| 3,320,768 | 5/1967 | Barrett | 62/345 X |
| 3,535,889 | 10/1970 | Curti | 62/345 X |
| 3,863,462 | 2/1975 | Treuer | 62/345 |
| 3,913,349 | 10/1975 | Johnson | 62/352 |
| 4,107,943 | 8/1978 | Ohling | 62/352 X |

FOREIGN PATENT DOCUMENTS

| | | | |
|---|---|---|---|
| 754253 | 1/1931 | France | 62/345 |

*Primary Examiner*—William E. Tapolcai, Jr.
*Attorney, Agent, or Firm*—Keith Schoff

[57] ABSTRACT

Cube or flake ice is provided by spraying atomized water against the bottom of a mechanically refrigerated plate or against a revolving disc disposed in facing contact with such a suface or with a wall of a freezing compartment of a household refrigerator, the water mist impinging on the surface freezing on contact to coat the surface and fill any concavities with ice, which is loosened to drop into a collecting bin by a defrosting cycle effected either by causing the flow of refrigerant in refrigeration tubing embodied in a stationary plate to be reversed in periodic, sequential order among several sectors in the plate, or by the action of a revolving disc carrying ice formed thereon continuously past a sector which is heated electrically or by incorporation of refrigerant condensing coils to produce in continuous or semi-continuous manner cubes, chips or flakes of ice.

12 Claims, 7 Drawing Figures

ICE MAKING APPARATUS

This application is a continuation-in-part of Ser. No. 936,233 filed Aug. 24, 1978 and Ser. No. 793,936, filed May 5, 1977, now abandoned.

FIELD OF INVENTION

Mechanically refrigerated ice making machines provide discrete small pieces of ice for convenience use in icing beverages and beverage containers. For clear ice to be produced, agitation of the water is necessary to prevent bubbles of dissolved gas or air from forming and clouding the ice as it freezes. Typically, ice produced in household refrigeration appliances appears semi-opaque from the inclusion of air, and clear ice produced commerically using sprayed water is made in batches by freezing and defrosting an entire surface alternately. Continuous or semi-continuous process freezing offers the advantage of uniform, substially uninterrupted constancy of output.

PRIOR ART

U.S. Pat. Nos. 3,320,768, 3,535,889, 2,246,741, and 3,863,462 all disclose freezing apparatus where the freezing surface is rotated during the freezing cycle, the first three showing the top of the freezing surface being configured with concavities. In U.S. Pat. Nos. 2,025,711 and 3,253,425 and French Pat. No. 754,253 flexible belts are shown which are configured with concavities for holding liquid to be frozen, the frozen contents being emptied by the endless belts being driven to invert the concavities. The prior art does not show defrosting of a freezer plate by disposing it in sliding contact with a heated surface and does not show apparatus in which heat is transferred through sliding contact between a member on which ice is formed and a stationary base which embodies refrigerant as a source for heat transfer to refrigerate and defrost the freezer plate.

SUMMARY OF THE INVENTION

Heat is conducted from the surface of a refrigerated plate or freezing chamber through contact with the face of a rotating disc onto which a spray of atomized water is directed. Ice forms to coat and fill concavities in the face of the disc and be carried by the advance of the disc to a defrosting sector which may comprise either electrical heating elements or condensing tubing for warm refrigerant. Defrosting occurs and ice is delivered in continuous manner as cubes, chips, or flakes to a collecting bin. In a semi-continuous process embodiment, only a stationary surface is used, which is sectorially divided and equipped with individual sets of refrigeration coils, each of which is fitted with a reversing valve for effecting reversal of flow of refrigerant fluid in the coils to provide a defrosting mode, rather than providing a shunt circuit which by-passes hot gas from the compressor past the condenser into the refrigeration coils without reversing flow, as is the practive in some prior art devices.

DRAWINGS

DESCRIPTION OF THE INVENTION

Figure 1:
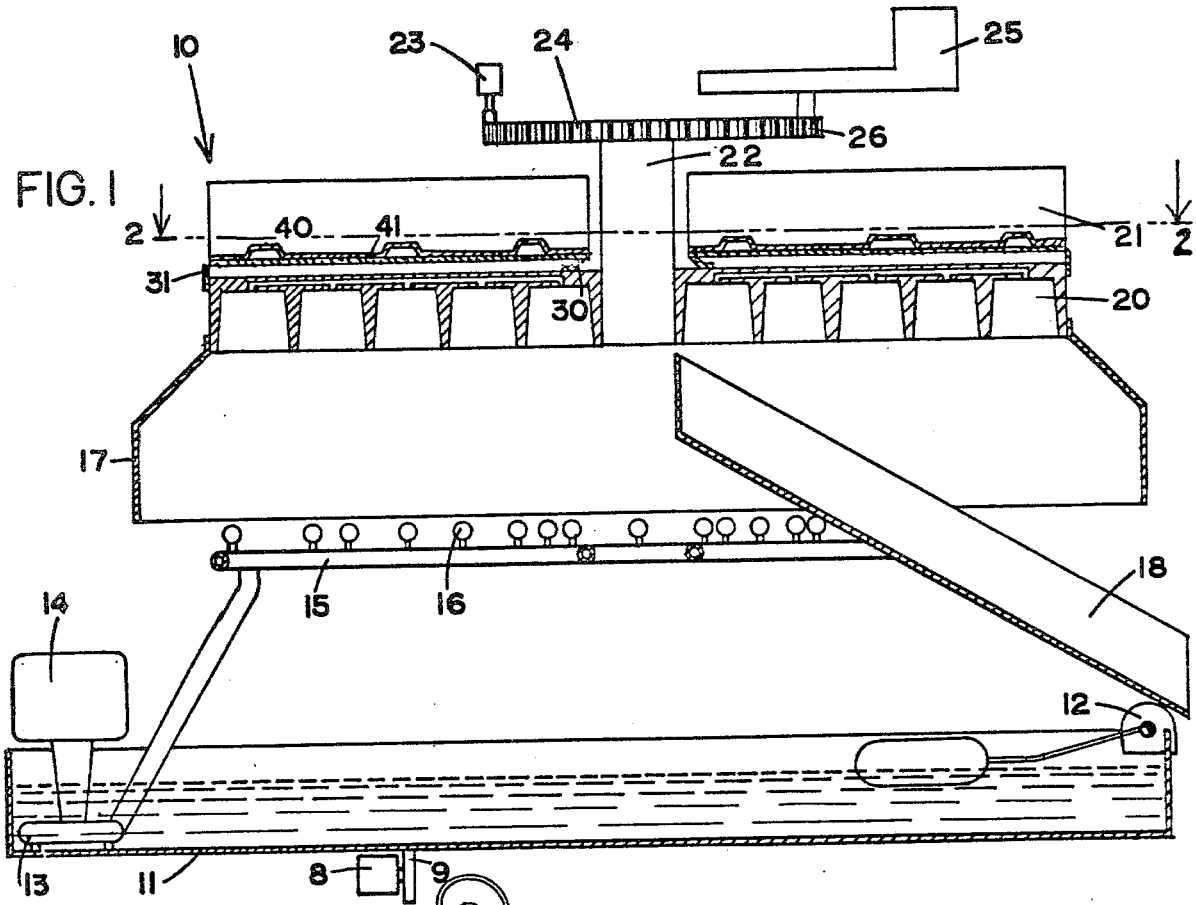
FIG. 1 is a cross-sectional side elevation as seen in cutting plane 1—1 of FIG. 2, of an embodiment of an ice making machine of this invention, without, however, showing of mechanical refrigeration components.

In FIG. 1, machine 10 is shown comprising water pan sump 11 fitted with float controlled water fill valve 12. Drain tube 9 of sump 11 is fitted with solenoid operated drain valve 8. Recirculating pump 13 for water is sump 11 is driven by electric motor 14 to discharge through nozzles 16 in manifold 15 and create an upwardly directed spray which impinges on the bottom surface of rotating member 20. Member 20 comprises a thermally conductive rotatable disc, preferably fabricated from aluminum or copper, configured with a bottom surface shaped into discrete concavities, which are shown as crenelations in the cross-sectional view of FIG. 1. The concavities may be shaped to provide cylindrical, cubical or other desired form to the discrete pieces of ice which form therein. Fenestrations are shown in member 20 communicating each concavity to atmosphere for providing a vacuum break for each concavity to assure gravity removal of ice from member 20 during the defrosting mode of operation. Member 20 is fixed on drive shaft 22 extending from drive gear 24, which in turn is driven by engagement with spur gear 26 carried by the output shaft of reduction gearing incorporated into the casing of motor 25.

Figure 2:
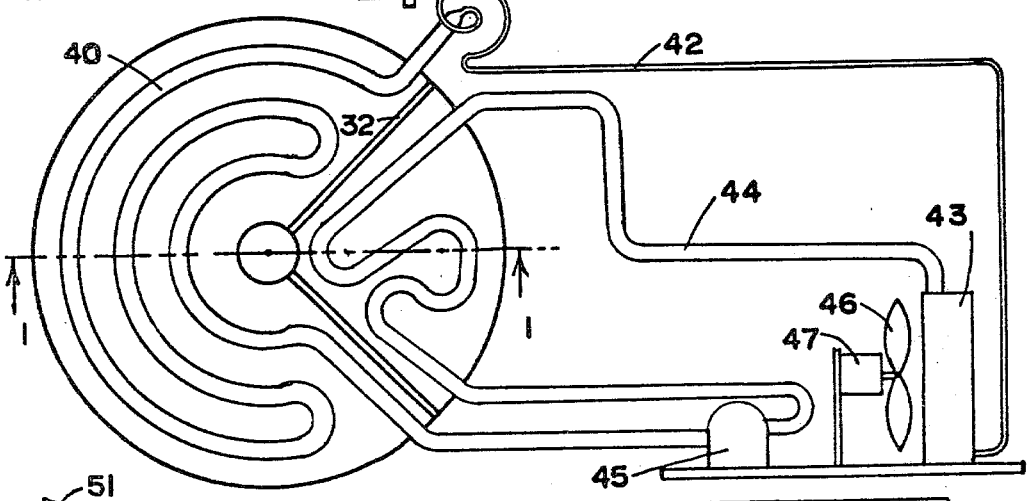
FIG. 2 is a plan view as partially seen in cutting palne 2—2 of FIG. 1, with mechanical revrigeration components shown schmatically.

Member 21 is stationarily fixed disc of similar peripheral size, and is in facial contact with member 20. Plate coil portion 41 of member 21 on the left hand side as shown in FIGS. 1 and 2 comprises a planar lower sheet and a tubeform embossed upper sheet which are joined and sealed to provide an efficient heat exchanger on the lower facing surface of member 21. The right hand side of plate coil portion 41 of member 21, as shown in FIG. 1, and the right hand quandrant of the plate coil portion as shown in FIG. 2 are of similar structure, but differ in serpentine configuration of the coil in providing a defrosting sector potion in the plate coil. Insulating dividers 32 are shown between the refrigerating and defrosting sectors of plate portion 41 and may comprise material of relatively low thermal conductivity such as porous or dense rubber or resinous material. Further insulation such as glass fiber batt may be placed over plate portion 41 within an enclosing metal or plastic cover for member 21. Tubing extensions may be connected to plate coil portion 41 for attachment to the refrigerant lines of the refrigeration unit as shown in FIG. 2, and notably, to an expansion valve at the terminus of liquid refrigerant line 42, which is not separately shown.

Chute 18 is provided under the defrosting quandrant of plate coil portion 41 of member 21 for directing ice dropping from member 20 clear of the rim of sump 11 and into a storage bin in the base of the machine. Chute 18 also prevents spray from nozzles 16 from impinging on the quandrant of member 20 which is operated in the defrosting mode.

Rdfrigerant material such as a member selected from a class consisting of fluorinated, chlorinated carbons and hydrocarbons, such as Freon ® may be charged to a sealed refrigerating loop comprising, as shown in FIG. 2, compressor 45, condenser 43, liquid line tubing 42 including expansion valve means, not shown, and sheet formed vapor defrosting coil 44 with tubing extensions. Fan 46 driven by electric motor 47 provides forced air circulation through cross-flow type condenser 43.

Figure 3:
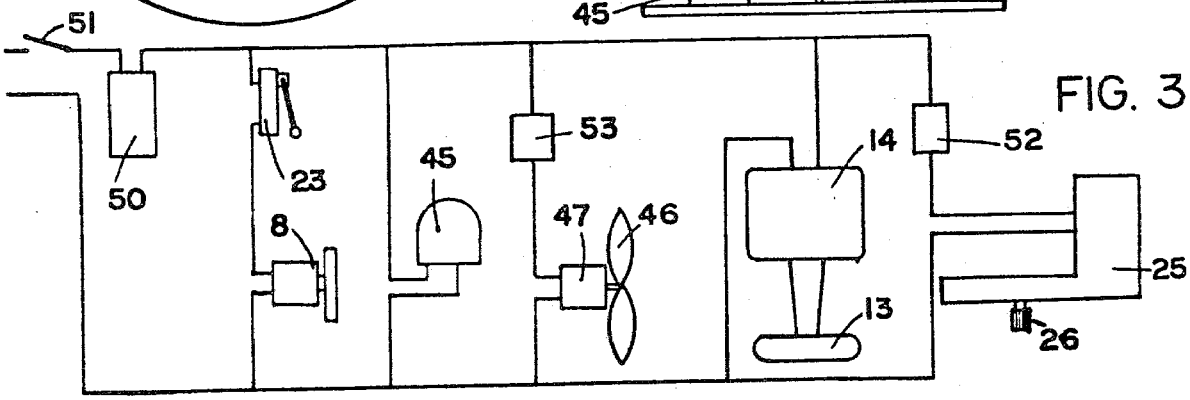
FIG. 3 is a schematic diagram of electrical circuitry of the machine of FIGS. 1 and 2.

Electrical circuitry for the embodiment of FIGS. 1 and 2 is shown in FIG. 3 where power switch 51 is provided in current conductor of a parallel wired alternating current circuit. Temperature sensor controlled switch 50 is of a type customarily used in food freezers, the temperature sensor causing switch 50 to be switched off when the temperature in the storage bin of machine 10 drops to a pre-determined level, the temperature of the bin being elevated above such temperature readily when the bin is opened to provide access for removing ice.

Limit switch 23 is actuated by passage of an appropriate detent, not shown, on gear 24, causing drain valve 8 to open and evacuate pump 11 of water periodically during operation of machine 10 to prevent dissolved solids from reaching excessively high concentration levels in the sump water.

Thermostatically controlled switch 53 comprises a temperature sensor placed to respond to the temperature of the inflow line to condenser 43, the sensor causing motor 47 to switch on and drive fan 46 when the line temperature exceeds a pre-set level, to assure that sufficient heat exchange to atmosphere occurs in the condenser to liquify the refrigerant as it passes through the condenser.

Motor speed control element 52 of conventional design can be manually set to control the rotational speed of motor 25, and thus, of rotatable disc 20. The size of discrete pieces of ice formed on member 20 is determined in part by the speed of rotation of member 20, with the piece becoming larger as the rotational speed becomes slower. Compressor 45 and motor 14 of circulating pump 13 run at all times that switches 50 and 51 are closed.

In operation, refrigerant is compressed in compressor 45 and circulates through sheet formed coil and connecting tubing 44 to warm one quandrant of stationary member 21. Heat is conducted by contact and through heat conducting lubricant from member 21 to the quandrant of member 21 which is disposed under the heated quandrant of member 21 at any given time. Seals 30 and 31 prevent the escape of the heat conducting lubricant from the contact surfaces. Member 20 is warmed sufficiently to provide surface heating of the ice deposited on the bottom of member 20, causing the discrete pieces to drop onto chute 18 and be conveyed by gravity into a bin for storage and dispensing. With continuing rotation of member 20, freezing and defrosting cycles become continuous as water spray from nozzles 16 impinges on three quadrants of member 20 which are refrigerated by contact with member 21 and freezes to fill the surface concavities on the bottom of member 20. Heat, abstracted from the water spray causing the water to freeze, is absorbed by refrigerant gas in sheet formed coil 40, which exhausts to the vacuum side of compressor 45 to complete the refigeration cycle. The process is continuous until interruped by opening of either switch 50 or 51. The operation and control of machine 10 is much simpler than that required for prior art devices.

Figure 4:
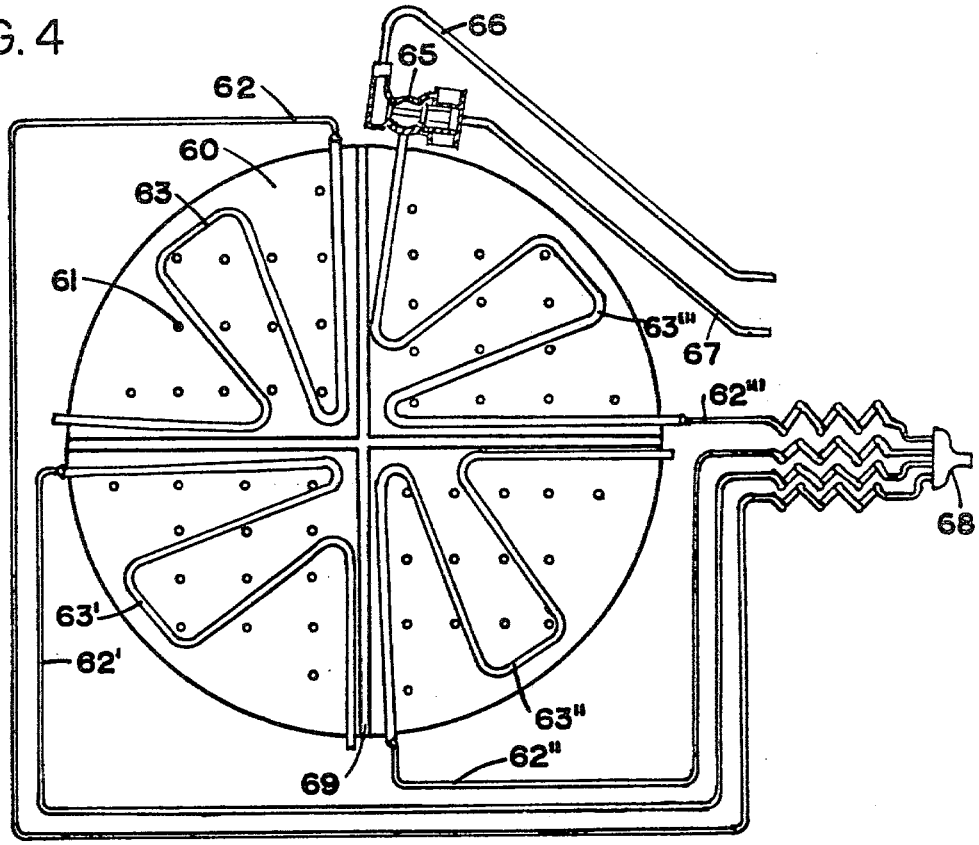
FIG. 4 is a plan view of another embodiment of an ice making machine of this invention shown without inclusion of mechanical refrigeration components.

In FIG. 4, an alternate embodiment of the invention is shown comprising plate 60, which is illustrated as circular, but which may be rectilinear in configureation, composed of quadrantal sectors separated by insulating strips 69. Fenestrations 61 communicate concavities formed by the bottom surface on the plate to atmosphere through the plate to provide a vacuum break for each concavity. Each quandrant of plate 60 is separately fitted with refrigeration coils 63, 63', 63'', 63'''. Only coil 63''' is shown fitted with associated control valve 65, however, each of the other coils 63, 63', and 63'' is similarly provided with control valves, which are omitted from the drawing in the interests of simplicity and clarity of portrayal. The ends of refrigeration coils 63, 63', 63'', and 63''' opposite to the ends fitted with control valves such as valve 65, are fitted with expansion valves such as 62''' shown. In the embodiment shown, all four of the refrigeration lines are mutually communicated at all times by manifold 68 for communication to the outlet of a refrigeration condenser, such means not being shown. Control valves such as valve 65 provided for each of the quadrants on refrigeration lines 63, 63', 63'', 63''' are operated in progressive sequence so that at any time three of such valves are communicating the refrigeration coils with suction lines such as suction line 66 on valve 65 and the fourth valve is communicating its associated refrigeration coil with a hot gas line such as line 67 connected to valve 65, to provide a defrosting mode. Switching of such valves may be manual or as preferred, may be by automatic timed sequence, a timed stepping switch controlling solenoid operators on each valve being a usable expedient, however, such means are not shown. It will be understood that the three quadrants operating at any one time in the refrigeration mode will draw liquid refrigerant from manifold 68 through expansion valvessuch as 62''' into the vapor line refrigeration coils, such as are lines 63, 63', 63'', 63''', while the fourth of such lines which is operating in the defrosting mode will receive hot refrigerant gas from a line such as 67, which gas will be caused to condense in the line and the resulting liquid refrigerant will be caused to mix with liquid refrigerant in manifold 68 and be carried to other of the quadrants. It is possiblebut not necessary to valve the refrigerant lines shown manifolded at manifold 68 to interconnect the three lines operating in the same mode and divert accumulation from the fourth line operating in the defrosting mode to the refrigeration apparatus condensing coil, such valving being sequenced by the same controller employed for use with valve 65 and like means, either manual or automatic. However, such means are not shown.

In operation, the underlying surface of the apparatus shown in FIG. 4 will be sprayed continuously with atomized water, some of which will freeze on contact with refrigerated surfaces of three of the quandrants, filling the concavities formed in such surfaces. Periodically in a timed sequence determined by the time required for ice build-up to occur to fill the concavities, one of the four sectors will be defrosted by hot refrigerant vapor being caused to be introduced into one of refrigeration coils 63, 63', 63'', 63''' thus causing ice to fall by gravity as discrete pieces and evacuate the concavities. After the programmed interval, the defrosted sector will be returned to refrigeration mode and defrosting will progress to a next sector. Either a rotating chute which indexes together with the progression of the defrosting mode around plate 60 may be provided under plate 60 to deflect loosened ice from the water pan sump, or a fixed conical or pyramidal grid or screen may be provided under plate 60 for the purpose. Operation of the refrigeration compressor may be accomplished, as shown in FIG. 2, by switch 50 of any conventional disign for ice bin control, and by switch 53 which may be of any conventional type of pressure actuated switch for sensing head presure regardless of refrigerant fluid temperature. It is preferred in the freezing plate members of the embodiments of this invention such as member 20 of FIG. 1 or plate 60 of FIG. 4 to provide radial insulating stips such as 69 in FIG. 4 to impede heat conduction between sectors of the freezing surface, for example in member 20 insulating strips might be placed at intervals of about thirty degrees of arc.

Figure 5:
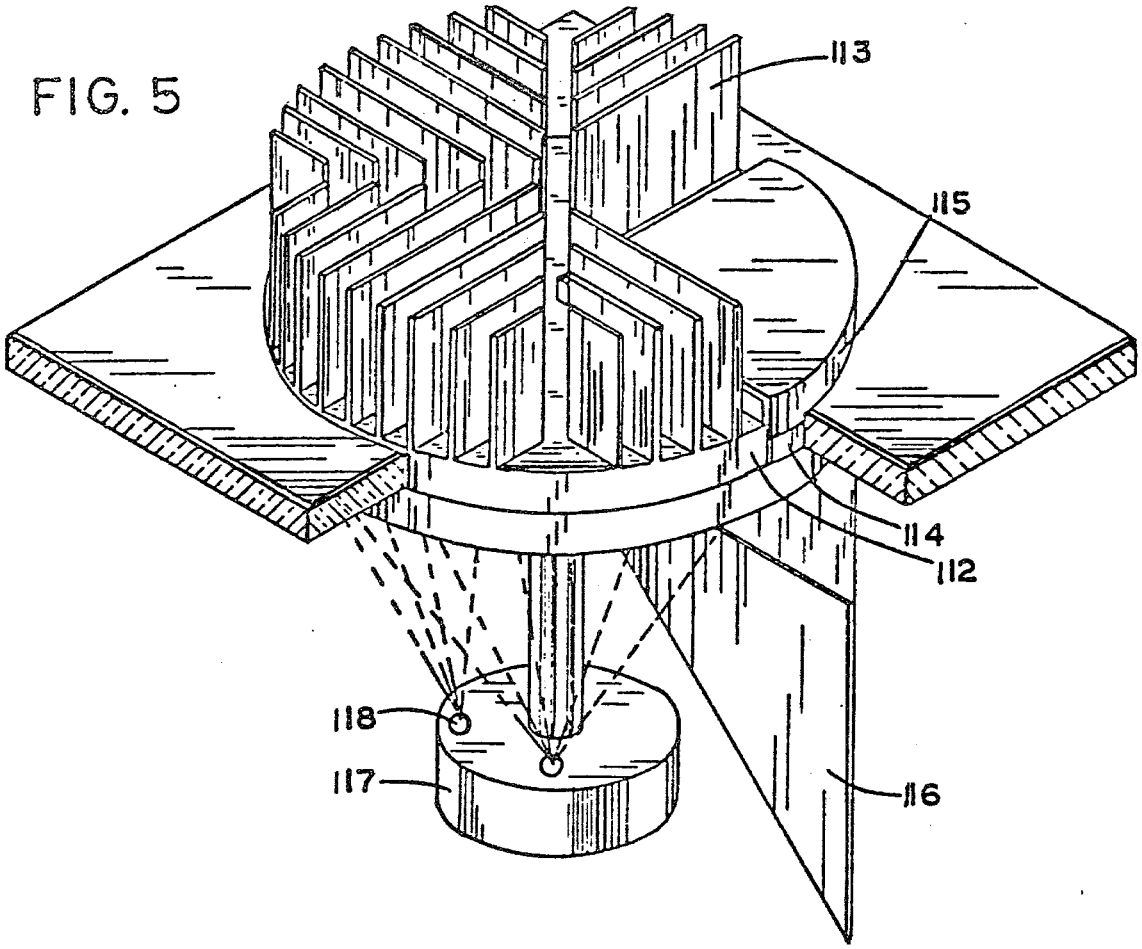
FIG. 5 is a perspective view in partial cut-away of another embodiment of an ice making apparatus of this invention.

In FIG. 5, another embodiment of the invention is shown where a section of the wall of a freezing compartment 111, such as might be found in a household refrigerator, is shown with a circular stationary plate 112 fixedly set therein providing an hermetic seal therewith. Integral heat transfer fins 113 project upwardly from plate 112 into the interior of the freezing compartment. The arrangement and design of the fins may be as shown or may be of any other operable configuration. Wall 111 may typically be that found in either a one door or two door refrigerator-freezer combination appliance. As shown, plate 112 is disposed horizontally and wall 111 is therefore the bottom wall of an elevated freezing chamber. Plate 112 and integral fins 113 preferably are cast, molded or fabricated from a material having high heat conducting value such as copper or aluminum, however, other material such as anisotropic graphite may be used. A quadrant of plate 112 is removed and replaced with a facing laminate of insulating material 115, such as foamed polyurethane or the like encased in a facing material of non-absorbing and non-combustible properties, and a defrosting element 114. Defrosting element 114 may comprise electric resistance heating wires or refrigerant condnser tubing to cause warming of element 114 to above the freezing temperature of water, preferably to about 55 degrees Fahrenheit.

Revolving plate 119 is disposed in physical contact with stationary plate112 by means of a bearing structure, not shown, and may be provided with a heat conducting lubricant at the interface of the two plates to facilitate easy rotation of plate 119 and heat transfer from plate119 to plate112. A relatively non-volatile, non-toxic material such as an aqueous solution or suspension of a freezing point depressant composition, salt or formulated lubricant or graphite may be used. Recirculating water pump 117 is provided directly below plate119 as shown in FIG. 1 in stationary position with atomizing nozzles118 directing spray upward onto the bottom face of revolving plate119 throughout the three quadrants which are in contact with stationary plate 112. As water is sprayed onto the cold face of plate 119, a portion of it freezes with residual amounts dripping from the surface of the plate and being caught in a drip pan, not shown, for return to a sump within pump 117. The bottom face of plate 119 is preferably configured with substantially cubical concavities for forming cubes of ice, but may be configured with surfaces condusive to forming cylinders or flakes of ice or other forms. A driving motor for pump 117 and for rotating plate 119 is incorporated into structure of pump 117. As plate 119 revolves continuously, ice which adheres to the bottom of plate 119 is progressively moved by rotation of plate 119 under the quadrant occupied by defrosting element 112 and upon being warmed by heat transmitted to plate 119 from element 112, loosens and falls by gravity into a collecting bin, not shown, guided thereto by deflecting plate 116. As the defrosted face of plate 119 advances away from the quadrant occupied by defrosting element 114, atomized water spray again impinges upon the bottom face of plate 119 in the refrigerated quadrants and freezes to build up a thickness of clear ice in the configuration of the surface concavities. A second plate similar to plate 116 bounds the other extremity of the volume under the defrosting sector, but is hidden from view; the two plates function both to guide and confine ice falling into a collection bin and to baffle the atomized spray from nozzles 118 to the refrigerated quadrants of plate 119.

Figure 6:
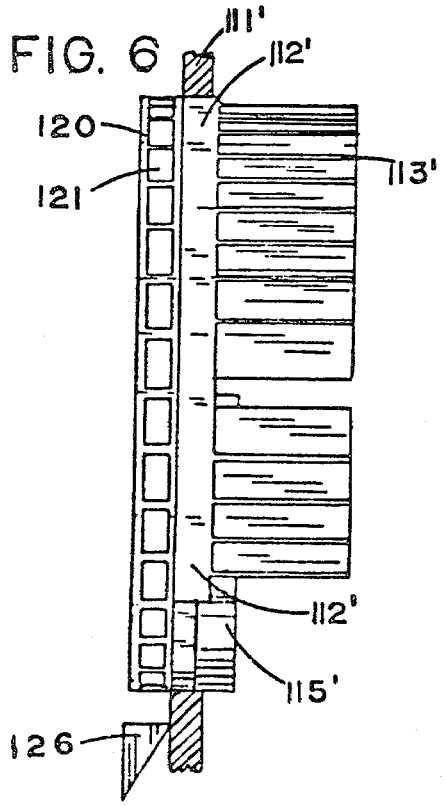
FIG. 6 is a side elevation of another embodiment of an ice making machine of this invention.
Figure 7:
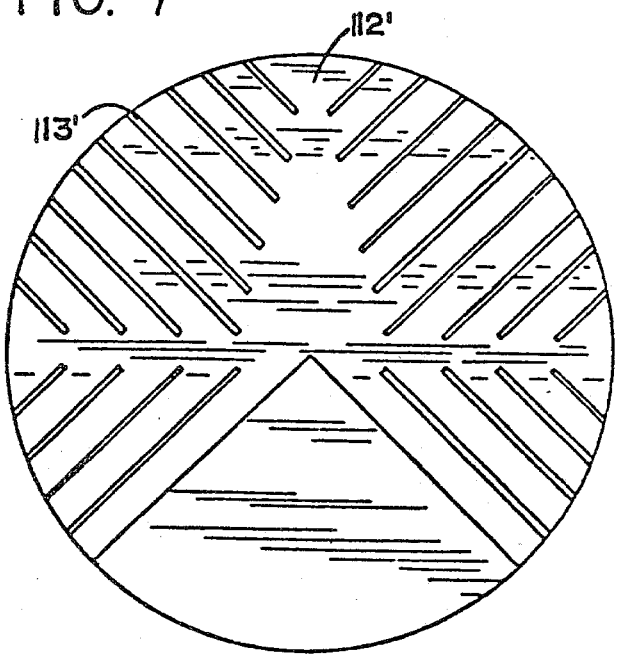
FIG. 7 is a front elevation of the apparatus of FIG. 6.

In FIG. 6, a modification of the apparatus is shown for use in mounting on the side wall of a freezing chamber. Plate 112' and fins 113' are similar to plate 112 and fins 113 of FIG. 5, but are oriented about a horizontal rather than a veritcal axis. Insulation 115' and heating element 114' are also similar to the counterpart members of FIG. 5, but are disposed as shown in FIG. 7 elevationally lowermost with respect to plate 112'. Revolving plate 120 comprises a periphery of radially recessed, nearly cubical cavities, into which atomized water is sprayed in the manner described relative to FIG. 5, or alternatively, may be dripped. The vertical face of plate 120 is planar and without features for forming freezing ice. Water sprayed onto plate 120 by means similar to pump 117 of FIG. 5, but not shown, is baffled by deflector plate 126 to prevent water from accumulating in the ice collection bin. A water collection tray may be provided around and below the collection bin in operable manner for returning the overspray and water drippings to the recirculating pump. Such means are conventional and are not shown.

The means of FIGS. 6 and 7 may conveniently be employed with larger size household freezers or with side-by-side household freezer and refrigerator appliances having a vertical wall separating the two compartments. In any embodiment of the invention described, clear ice is provided by freezing agitated, circulated water and without the use of refrigerating coils or controls therefore in the embodiments shown in FIGS. 5, 6 and 7. The only additional apparatus in the later embodiments is a motor powered water pump and rotating plate which is mounted in conjunction with the wall of a freezing compartment. As will be apparent, fins 113 and 113' may be fixed to wall 111 as well as being integral with plate 112; if desired, and plate 112 may be eliminated, however, such construction is not preferred. The apparatus may be controlled to provide a continuous supply of ice in cube form or the like until switched off either manually or by a sensor placed in the ice bin which monitors the level of ice piled in the bin.

I claim:

1. An ice making machine for producing ice in discrete small pieces by use of mechanical refrigeration, comprising in combination, (a) a stationary plate provided with at least two separate, integral passages containing fluid refrigerant wherein said passages are operably communicated by sealed connections to refrigerant lines external to said plate, (b) a refrigeration compressor wherein the outlet of said compressor is communicable to at least one said passage individually for providing hot, compressed vaporous refrigeration fluid in said passage to heat said plate and thaw ice deposited on a surface in proximity of said passage, (c) a refrigerant condenser for liquifying refrigerant vapor wherein the outlet of said condenser is communcable to at least another said passage individually for providing cold, rarified vaporous refrigeration fluid in said passage through means of an expansion valve to refrigerate said plate and freeze moisture deposited on a surface in proximity of said passage, (d) concavities configured in a surface underlying said plate, (e) pressurized water spray means wherein water spray is directed to impinge against said concavities, (f) means for effecting mutual progression of said concavities repetitively from proximity to one said passage heated to thaw ice deposited on said surface to proximity to another said passage refrigerated to freeze moisture deposited on said surface.

2. The apparatus of claim 1 wherein said pressurized water spray means comprises a recirculating pump end a water sump.

3. The apparatus of claim 1 wherein said stationary plate is arranged into sections with each said section being associated with one of said integral passages.

4. The apparatus of claim 3 wherein at least one of said integral passages is communicated with valving biasable to directionally reverse fluid flow through said passage for directing alternately hot compressed vaporous refrigerant fluid thereto, or cold rarified vaporous refrigerant fluid thereto.

5. The apparatus of claim 3 wherein said one said passage is disposed in permanent operative communication with said outlet of said refrigeration compressor, and wherein said another said passage is disposed in permanent operative communication with said outlet of said refrigerant condenser, and wherein said means for effecting mutal progression of said concavities comprises a rotatable disc disposed in underlying contact with said plate, and wherein said concavities are configured as the bottom surface of said disc, and wherein said sections are configured as radial sectors of said plate.

6. In a refrigerator having a freezing compartment, apparatus for making discrete ice pieces comprising in combination, a drive motor, a heat transfer plate driven rotatably about an axis by said drive motor, said plate having a planar surface in facing contact with an enclosure for said freezing compartment, said plate being configured with an exposed surface configured with concavities recessed therein, a water recirculating pump, said pump being connected to a water supply and to a drive motor, water discharge means associated with said pump for directing water to be deposited in said concavities, defrosting means fixedly disposed to warm and defrost a sector of said heat transfer plate as said plate passes in sliding contact therewith, said warming causing ice formed in said concavities to loosen and fall by gravity from said plate as discrete pieces of ice.

7. The device of claim 6 wherein said defrosting means comprises electric resistance heating elements.

8. The device of claim 6 wherein said defrosting means comprises refrigerant condenser tubing.

9. The device of claim 6 wherein said enclosure for said freezing compartment comprises a fixed planar section in contacting adjacency to said plate having a high heat transfer coefficient.

10. The device of claim 6 wherein a lubricant having a relatively high heat transfer coefficient is provided between said planar surface of said plate in facing contact with said enclosure of said freezing compartment, and said freezing compartment enclosure.

11. The device of claim 6 wherein fins of highe heat transfer material are disposed within said freezing compartment in contact with said enclosure subjacent to said heat transfer plate.

12. The device of claim 6 wherein said concavities are disposed about the periphery of said heat transfer plate.

* * * * *